United States Patent [19]

Kagawa

[11] Patent Number: 4,765,349

[45] Date of Patent: Aug. 23, 1988

[54] SYSTEM FOR CONTROLLING LAMINA SIZE IN A RAW MATERIAL TREATMENT PROCESS FOR TOBACCO LEAVES

[75] Inventor: Kenichi Kagawa, Hiratsuka, Japan

[73] Assignee: Japan Tobacco & Salt Public Corporation, Tokyo, Japan

[21] Appl. No.: 922,806

[22] Filed: Oct. 27, 1986

Related U.S. Application Data

[63] Continuation-in-part of Ser. No. 633,237, Jul. 23, 1984, abandoned.

[30] Foreign Application Priority Data

Jul. 21, 1983 [JP] Japan ..... 58-131980

[51] Int. Cl.[4] ..... A24B 3/18

[52] U.S. Cl. ..... 131/327; 131/311; 131/312

[58] Field of Search ..... 131/311, 312, 327

[56] References Cited

U.S. PATENT DOCUMENTS 2,771,079 11/1956 Umney .
3,410,280 11/1968 Wochnowski .
3,715,083 2/1973 Funk .

FOREIGN PATENT DOCUMENTS 1632152 1/1971 Fed. Rep. of Germany .
2249800 4/1973 Fed. Rep. of Germany .
1549705 6/1969 France .
719106 3/1968 United Kingdom .

*Primary Examiner*—V. Millin
*Attorney, Agent, or Firm*—Balogh, Osann, Kramer, Dvorak, Genova & Traub

[57] ABSTRACT

A system for controlling the lamina size, in a material treatment process for tobacco leaves. The system comprises measuring means for measuring the production ratio of the lamina larger than a given size in the raw material treatment process in which the tobacco leaves which have been provided with a water content and temperature by a humidity controller are stripped into laminae and ribs by means of rib removing machines capable of changing a mechanical impact force applied upon the tobacco leaves by changing the rotational speed of grid or threshing gear and are then separated by means of separating machines; and operational control means for receiving measurement signals from said measuring means as a feedback signal for searching a rotational speed of grid or threshing gear which provides an optimum lamina size by a hill-climb method using the rotational speed of grid or threshing gear of the rib removing machines as manipulation factor.

1 Claim, 5 Drawing Sheets

START
1
Preset of manipulation conditions(Xij).
2 Output of Xij
3 Wait
Input of lamina production ratio.
4
Calculation of threshing rate Yi.
5
YSET+δY≧Yi≧YSET−δY
6
YES
NO
STOP
7 N=N+1
9
X2,3=X1,3+δx
NO
N>2
8
YES
10 Y1,Y2>YSET
NO
12 Y1,Y2<YSET
NO
YES
Y1≧Y2
NO
YES
13 Y1≧Y2
NO
11 X1,3=X2,3−δx
X2,3=X1,3−δx
X2,3=X1,3+δx
X1,3=X2,3+δx
|Y1−YSET|>|Y2−YSET|
14
NO
YES
15 Y1>Y2
NO
YES
16 Y1>Y2
NO
YES
19 X2,3=X1,3−δx'
20 X2,3=X1,3+δx'
17 X1,3=X2,3+δx'
18 X1,3=X2,3−δx'

SYSTEM FOR CONTROLLING LAMINA SIZE IN A RAW MATERIAL TREATMENT PROCESS FOR TOBACCO LEAVES

This application is a continuation-in-part of application Ser. No. 633,237, filed July 23, 1984, now abandoned.

BACKGROUND OF THE INVENTION

The present invention relates to a system for controlling the lamina size in a raw material treatment process for tobacco leaves.

In general tobacco production process, tobacco leaves raw materials are separated each other and then are provided with a flexibility by the addition of water and steam from a humidity controller. Thereafter they are stripped into parenchyma (hereafter referred to as laminae) and veins (hereafter referred to as ribs) and separated into the laminae and ribs by separating machines. The laminae are dried to possess 12% of water content for avoiding change in quality and molding during a long term storage and then packed in a barrel or other container (abovementioned process be referred to as a raw material treatment process). The packed laminae are stored for a long time for maturing. The laminae which have finished maturing are threshed into cut cigarette after the steps of leaf orientation, blending and flavoring.

During the raw material treatment process, the tobacco leaves are stripped into laminae and ribs. The degree of this stripping gives a large influence upon a raw material yield and product quality. That is, the tobacco leaves are subjected to a great mechanical action when they are stripped into laminae and ribs. Accordingly insufficient separation between laminae and ribs is accomplished, or conversely excessive separation is accomplished so that the tobacco leaves are finely divided depending upon the physical properties possessed by the tobacco leaves. The physical properties depend on largely the water content and temperature.

Accordingly it is important to control a factor which gives influence upon the quality, that is, a mechanical impact force applied upon the tobacco leaves in a rib removing machine to that the impact force have an amplitude suitable for the tobacco leaves.

These controls have heretofore been manually carried out. This manual technique includes adjusting the mechanical impact applied upon the tobacco leaves in the rib removing machine to a suitable value by replacing a basket with that having a different pitch of grid.

It is practically difficult to replace the baskets of the rib removing machine to match the constantly varying inherent physical properties of the tobacco leaves, since they largely vary according to the production place, weather conditions of the production year. Therefore it is very difficult to control the quality by controlling the lamina size to an optimum value.

SUMMARY OF THE INVENTION

It is therefore an object of the present invention to provide a novel system for controlling the lamina size in a raw material treatment process for tobacco.

It is another object of the present invention to provide a system for controlling the lamina size in a raw material treatment process in which a mechanical impact force in a rib removing machine is automatically controlled in response to the physical properties of the tobacco leaves to provide an optimum lamina size.

In accordance with the present invention there is provided with a system for controlling the lamina size in a raw material treatment process for tobacco leaves comprising measuring means for measuring the production ratio of the laminae larger than a given size in the raw material treatment process in which the tobacco leaves which have been provided with a water content and temperature by a humidity controller are stripped into laminae and ribs by means of rib removing machines capable of changing a mechanical impact force applied upon the tobacco leaves by changing the rotational speed of grid or threshing gear and are then separated by means of separating machines and operational control means for receiving measurement signals from said measuring means as a feedback signal for searching a rotational speed of grid or threshing gear which provide an optimum lamina size by a hill-climb method using the rotational speed of grid or threshing of the rotary rib removing machines gear as manipulation factor.

DETAILED DESCRIPTION OF THE EMBODIMENTS

The present invention will be described by way of an embodiment with reference to the drawings.

Figure 1:
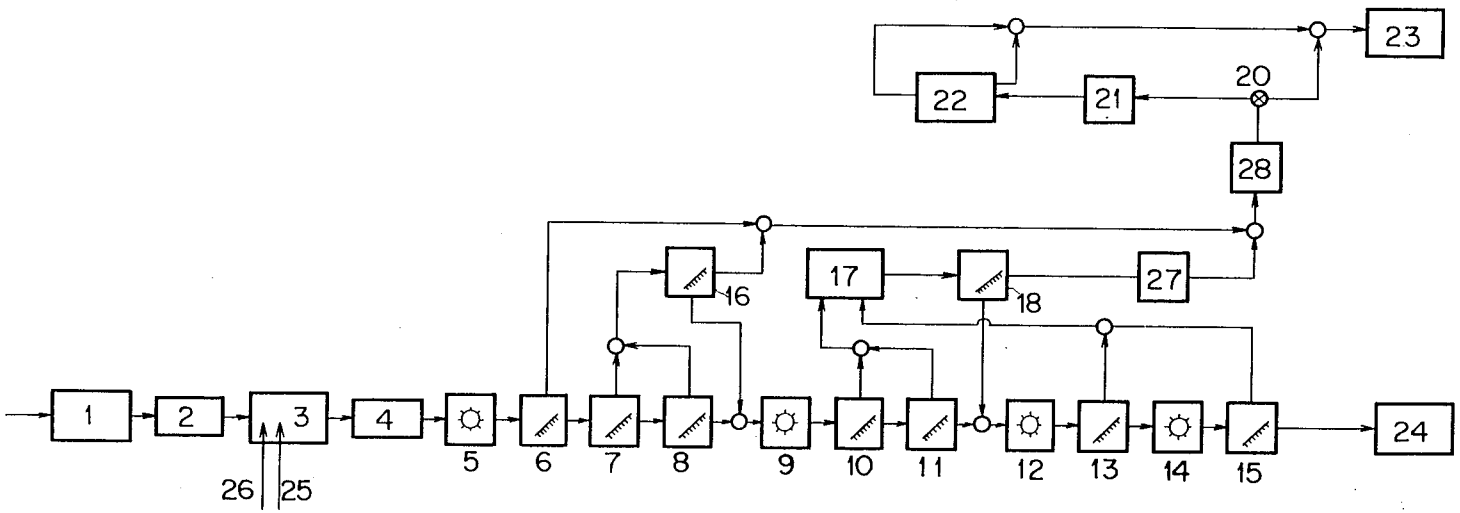
FIG. 1 is a block diagram showing the entire raw material treatment process of the tobacco leaves.

Referring now to FIG. 1, there is shown a process for treating raw material of tobacco. The tobacco leaves supplied from a supplier 1 are controlled by a flow rate controller 2 so that they are conveyed at a predetermined flow rate and then are supplied to a humidity controller 3. In the humidity controller the tobacco leaves are provided with a flexibility necessary for rib removal by addition of water and steam which is sprayed from water and steam nozzles 25 and 26 respectively. The tobacco leaves which have finished humidity control are separated into laminae and ribs by means of rib removing machines 5, 9, 12 and 14 and furthermore separated by separating machines 6, 7, 8, 10, 11, 13, 15, 16 and 18.

In FIG. 1 reference numerals 4 and 21 represent feeders; 17 a conveyer assembly; 20 a sampler; 22 a device for measuring the size of laminae; 23 and 24 silos; 27 and 28 weight meters for measuring the flow rate of laminae.

Figure 2:
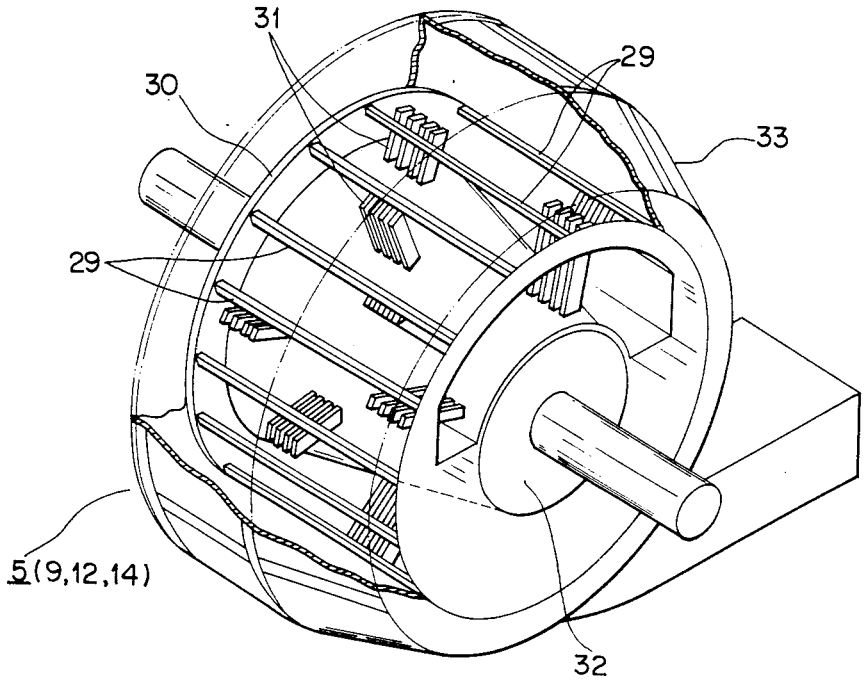
FIG. 2 is a partially cutaway perspective view showing a rotary rib removing machine.

Each of the aforementioned rib removing machines 5, 9, 12 and 14 comprises a cylindrical grid member 30 having grids 29 disposed at given intervals therein, a truncated core member 32 within the grid member 30 having a plurality of threshing gears 31 disposed on the outer periphery thereof and a casing which encloses the grid member 30 as shown in FIG. 2. When the tobacco leaves are charged into a spacing between the grid member 30 and the core member during the rotation of the grid member 30, a mechanical impact force acts upon the tobacco leaves from the grids 29 and threshing gears 31. The tobacco leaves are separated into the laminae and the ribs when they come out from the space between grids 29 and enter into the space between the grid member 30 and the casing 33.

Figure 3:
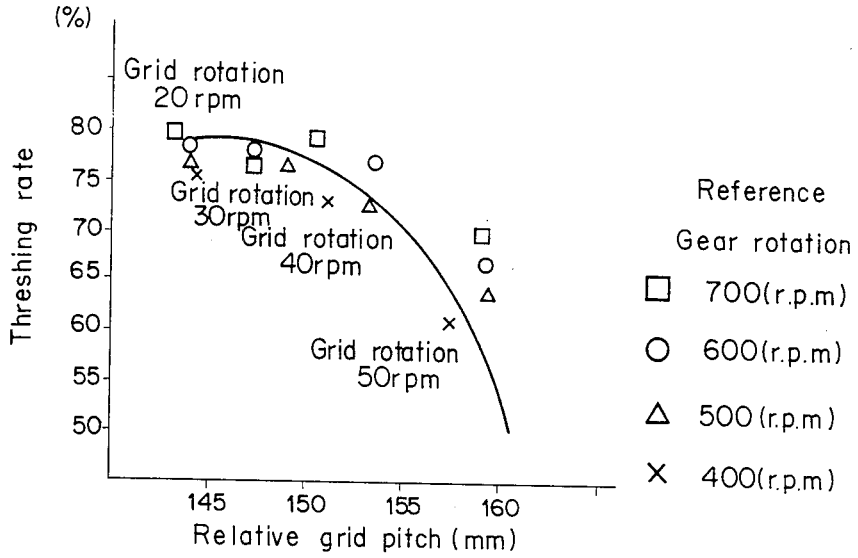
FIG. 3 is a graph showing the quality characteristics.

The rib removing machines 5, 9, 12 and 14 are capable of changing the mechanical impact force acting upon the tobacco leaves by changing the rotational speed of the grid member 30 (the grid rotational speed) to change relative grid pitch (relative spacing between the grids 29 and the threshing gears 31). In other words, the threshing rate can be adjusted by changing the relative grid pitch (refer to FIG. 3).

The grid member 30 may be secured and the core member 32 may be rotated. In this case, the threshing rate is changed by changing the rotational speed of the core member 32 (threshing gear rotational member).

Figure 4:
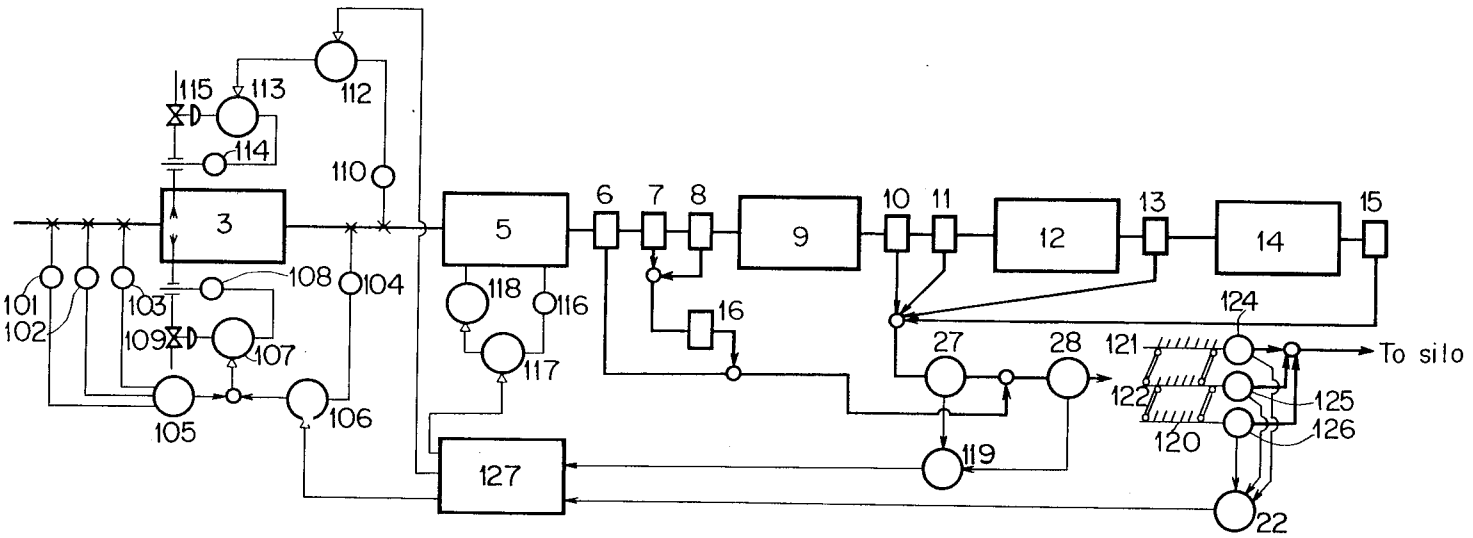
FIG. 4 is a block diagram showing one embodiment of the control system of the present invention.

Referring to FIG. 4, there is shown an embodiment of the control system of the present invention. Detectors 101, 102 and 103 for detecting the water content, temperature and flow rate of the tobacco leaves respectively are disposed at the entrance of the humidity controller 3. The water content, temperature, and flow rate of the tobacco leaves conveyed to the humidity controller 3 are measured so that the measurements are applied to an operational device 105. The operational device 105 calculates the amount of water to be added upon the basis of the measurement and a preset value of the water content given to the tobacco leaves, which is stored in a PiD adjuster 106. The calculated value is a cascade preset value for a PiD adjuster 107.

On the other hand, a detector 104 for detecting the water content is disposed at the exit of the humidity cotroller 3 so that the water content of the tobacco leaves which have been provided with water is measured and the measurement is applied to the PiD adjuster 106 as a feedback signal.

The PiD adjuster 106 which stores a preset value of the water content given to the tobacco leaves compares the preset value with the measured value and carries out PiD compensation and provides a signal when there is a deviation therebetween. The output signal is added to the signal (calculated value) of the aforementioned operational device 105 so that the cascade preset value of the PiD adjuster 107 is corrected.

The water nozzle 25 is provided with a control valve 109 which is controlled by an output signal from the PiD adjuster 107. The amount of water which is controlled by the control valve 109 is measured by the flow rate detector 108. When there is a deviation between the measured value and cascade preset value the PiD compensation is carried out by the PiD adjuster 107.

A temperature detector 110 as well as the water content detector 104 is disposed at the exit of the humidity controller 3. The temperature of the tobacco leaves discharged from the humidity controller 3 is measured. The measurement is applied to a PiD adjuster 112 as a feed back signal.

The preset value representative of the temperature imparted to the tobacco leaves is stored in the PiD adjuster 112 where the preset value is compared with the measurement. If there is a deviation therebetween the PiD adjuster is adapted to PiD compensation for the deviation and outputs a signal. The output signal provides a cascade preset value for the PiD adjuster 113 which controls the control valve 115 disposed at the steam nozzle 26. The flow rate of the steam which is controlled by the control valve 115 is measured by the flow rate detecting portion 114. If there is a deviation between the measurement and the cascade preset value, PiD compensation for the deviation is accomplished by the PiD adjuster 113.

The rotational speed of the grid of the first rib removing machine 5 is measured by a tachometer 116. The measurement is input to a PiD adjuster 117.

An optional rotation speed of the grid necessary for rib removing is stored in the PiD adjuster 117. If there is a deviation between the preset value and the measurement, the PiD adjuster then PiD compensates for the deviation and outputs a signal to a rotational speed controlling motor 118.

The laminae which have been stripped from the tobacco leaves in the rib removing machines 5, 9, 12 and 14 are separated fro the ribs by the rib removing machines 6, 7, 8, 10, 11, 13, 15, 16, 18 and then fed to a vibration type sifter 120. Before reaching at the sifter 120 the laminae pass through the aforementioned weight meters 27 and 28 where the flow rate of them is measured.

The weight meter 27 measures the flow rate of the laminae stripped by the second and subsequent rib removing machines 9, 12, and 14. The weight meter 28 measures the flow rate of the laminae stripped by all the rib removing machines 5, 9, 12 and 14. The results of these measurements are applied to the operational device 119.

The operational device calculates the ratio of the flow rate of the laminae stripped by the first rib removing machine 5 to the flow rate of the laminae stripped in the course of the whole rib removing process, that is, a lamina production ratio from the aforementioned measurements. The relation between the lamina production ratio and the aforementioned threshing rate is expressed by the following formula:

$$\text{Threshing rate} = \text{lamina production ratio } X\alpha$$

wherein $\alpha$ is a constant determined by the separating machine 6.

The calculated value (lamina production ratio) from the operational device 119 is input to the operational control device 127 as a feedback signal. The operational control device 127 searches an optimum value of the rotational speed of the grid to be preset to the PiD adjustor 117 in response to the feedback signal. The relation between the threshing rate of the first rib removing machine and the production ratio of the laminae not larger than a predetermined size such as 13 mm will be described with reference to FIG. 5 before describing the operation of the operational control device 127.

Figure 5:
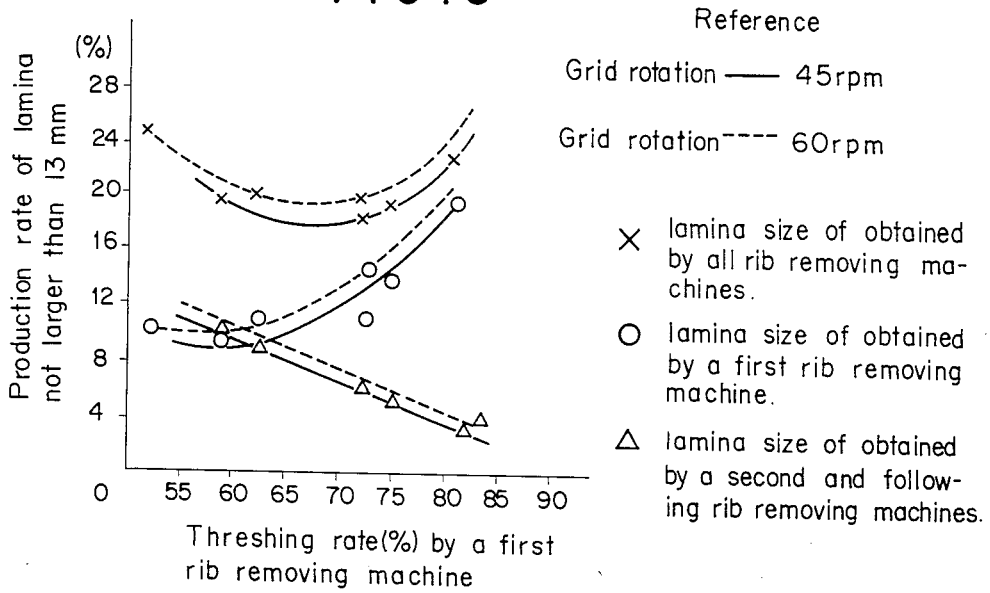
FIG. 5 is a graph showing the quality characteristics.

As shown in FIG. 5 when the threshing rate of the first rib removing machine 5 increases, the production ratio of the laminae not larger than a predetermined size, such as 13 mm correspondingly increases while the laminae not larger than 13 mm produced at the second and subsequent rib removing machines 9, 12 and 14 decreases since the load imposed upon the second and subsequent rib removing machines 9, 12 and 14 decreases. Accordingly when the threshing rate of the first rib removing machine 5 is decreased, the production rate of the laminae not larger than 13 mm of the rib removing machines 5, 9, 12, 14 as a whole varies according to a parabolic curve. In this case, when the threshing rate of the first rib removing machine 5 is 75%, the production rate of the laminae not larger than 13 mm at the whole of the rib removing machines 5, 9, 12 and 14 is minimal. It is preferable that this production rate is as low as possible since adverse influence is given to the quality in the subsequent process when many laminae not larger than 13 mm produces.

The aforementioned relation varies depending upon the physical properties of the tobacco leaves. Accordingly the operational device 127 uses the relation between the threshing rate (lamina production ratio and the production ratio of the laminae not larger than 13 mm and is adapted to search such a rotational speed of grid that an optimum threshing rate which minimizes the production rate of the laminae not larger than 13 mm using a simplex method one of hill-climb method determining an optimum manipulating condition upon the basis of the lamina production ratio input from the operational device 119.

Figure 6:
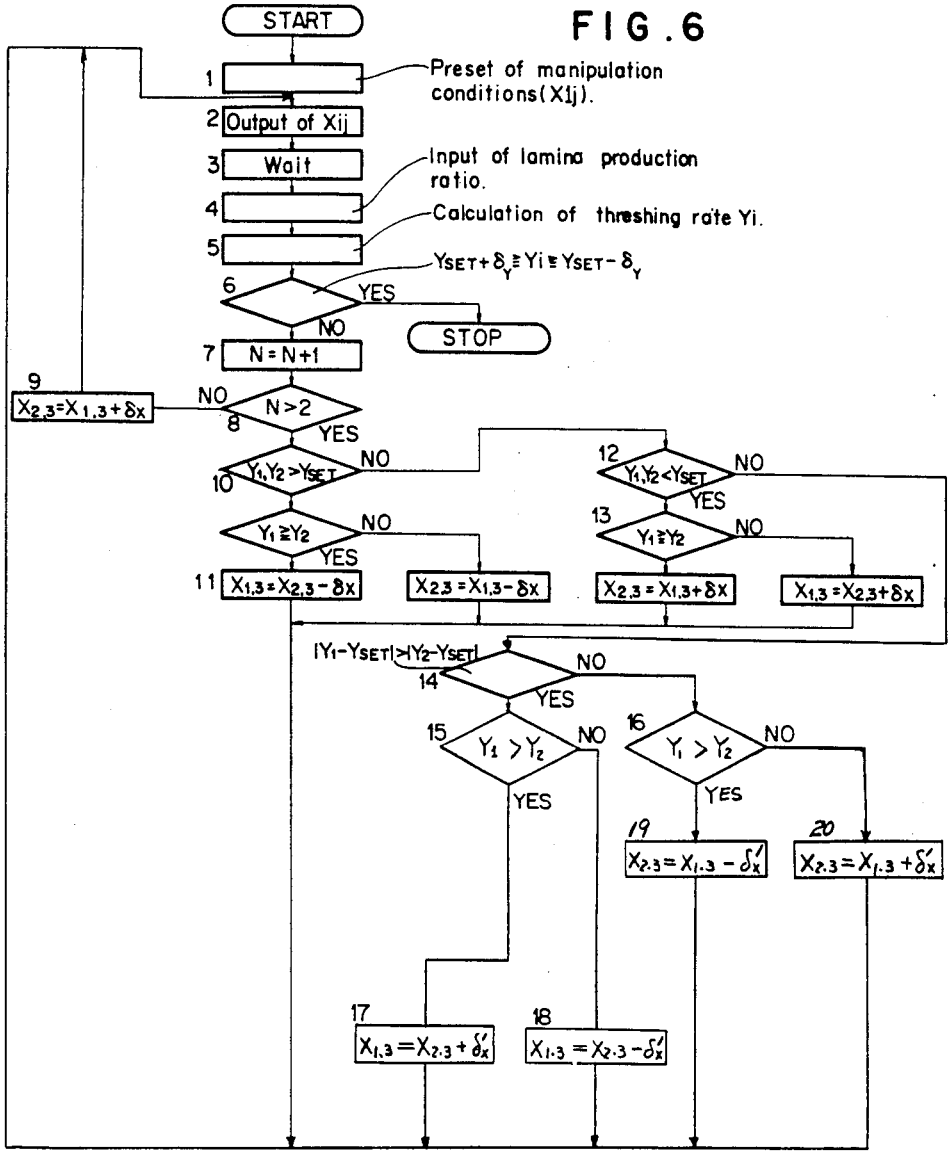
FIG. 6 is a flow chart illustrating the operation of the operational control device.

FIG. 6 is a flow chart showing the operation of the operational device 127.

A manipulating condition is expressed by $X_{ij}$ where reference j represents manipulating factors: j=1 for water content, j=2 for temperature, and j=3 for rotational speed of the grid, and i represents levels of each manipulating factor. In Step 1, a manipulating condition $X_{1,j}$, which is considered to be preferable from a past experience of operation, is determined as shown in FIG. 6, i.e., the manipulating conditions $X_{1.1}$, $X_{1.2}$, and $X_{1.3}$ are determined and preset for the PiD adjustors 106, 112, and 117, respectively, in Step 2. The manipulating conditions $X_{1.1}$ and $X_{1.2}$ will remain the same throughout the program, and only the rotational speed of the grid, $X_{1.3}$, will be altered in subsequent steps according to the operation shown in the flow chart in FIG. 6.

Under such manipulation conditions $X_{1.1}$, $X_{1.2}$ and $X_{1.3}$, the tobacco leaves are provided with water and temperature by the humidity controller 3. Laminae are stripped from the tobacco leaves by the rib removing machines 5, 9, 12 and 14. They are then separated into laminae and ribs by separating machines 6, 7 and 8. The flow rate of the separated laminae is measured by the weight meters 27 and 28. The lamina production ratio is calclated by the operational device 119 in response to the measurements.

In Step 3, the program waits for the operational device 119 to output the laminae production ratio. The laminae production ratio is read into the operational device 127 from the operational device 119 in Step 4. The threshing rate, Yi, is then calculated from the laminae production ratio in Step 5, where Yi is a threshing rate corresponding to $X_{i.3}$, a level of the rotational speed of the threshing grid. Then the threshing rate Yi is checked whether or not it falls in the target range of threshing rate ($Y_{SET} \pm \delta_Y$), where $Y_{SET}$ is 75%, a preset value of the threshing rate for which an optimum rotational speed of the grid is to be searched, and $\delta_Y$ is the allowable upper and lower limits of $Y_{SET}$. If the threshing rate $Y_1$ corresponding to $X_{i.3}$ falls in the target range, then the experiment is finished. If it does not fall in the target range, the program proceeds to Step 7.

A number of experiment N with its initial value 1 is incremented by one in Step 7. The N is checked whether or not it is greater than two in Step 8. If N is greater than two, then the program proceeds to Step 10. If N is not greater than two, the program proceeds to Step 9 to determine another rotational speed of the threshing grid $X_{2.3}$ in accordance with the following equation:

$$X_{2.3}=X_{1.3}+\delta_x$$

where $\delta_x$ is a change in rotational speed of the threshing grid which is predetermined appropriately. The steps 2 through 8 are repeated with a new value of rotational speed of the threshing grid. The two measurements $Y_1$ and $Y_2$ obtained through the above steps are checked whether or not they are greater than the preset value $Y_{SET}$ in Step 10. If the measurements $Y_1$ and $Y_2$ are not larger than the preset value $Y_{SET}$, the program proceeds to Step 12. If the measurements $Y_1$ and $Y_2$ are larger than the preset value $Y_{SET}$, and if $Y_1$ is greater than or equal to $Y_2$, then the program proceeds to Step 11, and a new value for $X_{1.3}$ is determined by subtracting dx from a rotational speed, which results in a threshing rate closer to the preset value $Y_{SET}$. That is, if the measurement $Y_1$ is greater than $Y_2$, then $X_{1.3}$ is assigned a new value determined in accordance with the following equation:

$$X_{1.3}=X_{2.3}-\delta_x.$$

If the measurement $Y_1$ is smaller than $Y_2$, then $X_{2.3}$ is assigned a new value determined in accordance with the following equation:

$$X_{2.3}=X_{1.3}-\delta_x.$$

A measurement closer to the preset value $Y_{SET}$ is left as it is. Step 14 is a case where $Y_1$ falls in a region higher than $Y_{SET}+d_y$ and $Y_2$ falls in a region lower than $Y_{SET}-d_y$ or vice versa.

If $[Y_1-Y_{SET}]$ is greater than $[Y_2-Y_{SET}]$, then $Y_2$ is closer to $Y_{SET}$ than $Y_1$. The program proceeds to Step 15. If $Y_1$ is greater than $Y_2$, the $X_{1.3}$ is assigned a new value determined by the following equation:

$$X_{1.3}=X_{2.3}+\delta'_x$$

where $\delta'_x$ is smaller than dx, for example, dx/2.

If $Y_1$ is not greater than $Y_2$, then $X_{1.3}$ is assigned a new value determined by the following equation:

$$X_{1.3}=X_{2.3}-\delta'_x.$$

If $[Y_1-Y_{SET}]$ is not greater than $[Y_2-Y_{SET}]$, then $Y_1$ is closer to $Y_{SET}$ than $Y_2$. The program proceeds to Step 16. If $Y_1$ is greater than $Y_2$, then $X_{2.3}$ is assigned a new value determined by the following equation:

$$X_{2.3}=X_{1.3}-\delta'_x.$$

If $Y_1$ is not greater than $Y_2$, then $X_{2.3}$ is assigned a new value determined by the following equation:

$$X_{2.3}=X_{1.3}+\delta'_x.$$

The operation is repeated from Step 2 with a newly determined rotational speed of the threshing grid, $X_{i.3}$.

In such a manner, experiment of stripping laminae at a rotational speed of grid calculated by the operational device 127 is repeated to search such an optimum rotational speed of grid that a threshing rate which provides a minimum production rate of the laminae not larger than 13 mm is obtained.

If the optimum rotational speed of grid is searched by the operational device 127, laminae are stripped at the optimum rotational speed of grid from the tobacco leaves which have been provided with water content and temperature and then laminae are separated from ribs.

Accordingly, even if the physical properties etc. of the raw material tobacco leaves fed to the raw material treatment process changed it is possible to quickly respond the changes and maintain the production rate of laminae not larger than for example, 13 mm as low as possible.

The laminae which have been separated from the ribs are fed to the aforementioned sifting machine 120 where they are sifted by two sifters 121 and 122. The flow rate of the laminae sifted by the sifters 121 and 122 are measured by the weight meters 124, 125 and 126. The measurements are input to the lamina size measuring device 22 where the production rate of the laminae not larger than 13 mm is calculated.

The aforementioned operational control device 127 has also a function to receive a signal representative of the production rate of the laminae not larger than 13 mm and to search optimum values of water content, temperature and rotational speed of grid which minimize the production rate of the laminae not larger than 13 mm by a symplex method using the water content and temperature provided by the humidity controller 3 and the rotational speed of grid as manipulating factors.

Although there is described a case in which a rotational speed of grid is searched so that a threshing rate which minimizes the production rate of the laminae not larger than 13 mm is obtained. Briefly all we have to do is to search such a rotational speed of grid where a threshing rate minimizing the production of the laminae having a size which adversely affects the quality in the course of the subsequent process. In other words, all we have to do is to search a rotational speed of grid providing a mechanical impact force (stripping force) which minimizes the production rate of the laminae having a size which adversely affects the quality in the course of the subsequent process.

Although there are shown rib removing machines in which grids are rotated, rib removing machines in which grids are fixed and threshing gears are rotated may be used. In the latter case; the rotational speed of threshing gear is searched which provides a mechanical impact force minimizing the production rate of the laminae which adversely affects the quality in the subsequent process.

As described above, the present invention includes means for measuring the production ratio of the laminae in the raw material treatment process and means to receive a signal representative of the lamina production ratio for searching the rotational speed of grid or threshing gear providing optimum lamina size by a hill-climb method using rotational speed of the grid or threshing gear of the rib removing machine as manipulating factor. Therefore even when the physical properties etc. of the tobacco leaves is changed, the mechanical impact force upon the tobacco leaves in the rib removing machine may be correspondingly rapidly changed so that the lamina size is controlled to a minimum value to easily control the quality.

What is claimed is:

1. In a raw material treatment process for tobacco arranged by cascading a plurality of rib-removing processes where tobacco leaves are separated into laminae and ribs by a plurality of separating machines after the leaves are given a water content and temperature by a humidity controller and the laminae are threshold from the leaves by a plurality of rotary rib-removing machines having variable physical impact force to the leaves by changing the revolution of the grid or threshing gear, a method for controlling a raw material treatment process comprising the steps of (1) setting a target range of ratios of an amount of laminae thresh separated by a first rib-removing process to an amount of laminae thresh separated by all rib-removing processes, said range having predetermined upper and lower limits; (2) setting a set of preferable operating conditions each including levels concerning the moisture in the humidity controller, the temperature in the humidity controller and the revolution of a first rotary rib-removing machine for which preferable values of the levels are determined from a past experience of operation, and computing further a set of operating conditions above said preferable operating conditions by modifying said revolution of the first rotary rib-removing machine; (3) threshing the tobacco leaves by having all rib-removing processes operated at each set of operating conditions to produce laminae separated from the tobacco leaves, and weighing the amount of laminae separated by said all rib-removing processes and the amount of laminae separated by the first rib-removing process; (4) computing the ratio of the amount of the laminae separated by the first rib-removing process to the amount of the laminae separated by all rib-removing processes; (5) dropping a revolution of the first rotary rib-removing machine which yields the most distant threshing ratio from said target range of ratios if said ratio of the first rib-removing process is outside the predetermined upper and lower limits upon judgement by comparing the ratio corresponding to each set of operating conditions with said target range of ratios, and computing a new value of the revolution which is to be newly set for the first rotary rib-removing machine through a predetermined mathematical operation and outputting said new value of revolution to the first rotary rib-removing machine; (6) threshing the tobacco leaves by having all rib-removing processes operated at a set of operating conditions with said new value of revolution of the first rotary rib-removing machine to produce the laminae separated from tobacco leaves, and weighing the amount of said laminae separated by all rib-removing processes and the amount of said laminae separated by the first rib-removing process; (7) computing the ratio of the amount of laminae separated by the first rib-removing process and the amount of laminae separated by all rib-removing processes at the set of operating conditions with said new value of revolution of the first rotary rib-removing machine; (8) dropping the revolution of the first rotary rib-removing machine which yields the most distant ratio from said target range of ratios if said ratio is outside the predetermined upper and lower limits upon judgment by comparing the ratio corresponding to the set of operating conditions with the new value of revolution of the first rotary rib-removing machine and the previous one remaining set of operating conditions and computing further the new value of revolution which is to be newly set for the first rotary rib-removing machine through the predetermined mathematical operation and outputting said further new value of revolution to the first rotary rib-removing machine; and (9) repeating the steps (6) through (7) in sequence until either the ratio at one set of operating conditions with the further new value of revolution of the first rotary rib-removing machine or the ratio at the previous one remaining set of operating conditions is within the target range of ratios of the amount of the laminae thresh separated by the first rib-removing process to the amount of the laminae thresh separated by all rib-removing processes.

* * * * *